US006097917A

United States Patent [19]

Park

[11] Patent Number: 6,097,917

[45] Date of Patent: Aug. 1, 2000

[54] DEVELOPER REMOVING APPARATUS OF LIQUID PRINTER

[75] Inventor: Gyeong-ho Park, Suwon, Rep. of Korea

[73] Assignee: Samsung Electronics Co., Ltd., Kyungki-do, Rep. of Korea

[21] Appl. No.: 09/305,715

[22] Filed: May 5, 1999

[30] Foreign Application Priority Data

May 13, 1998 [KR] Rep. of Korea ..... 98-17193

[51] Int. Cl.[7] ..... G03G 15/10

[52] U.S. Cl. ..... 399/249; 399/348

[58] Field of Search ..... 399/249, 237, 399/233, 57, 149, 348, 358, 343; 118/63; 430/117–119; 347/22, 33, 23, 30; 15/401, 121, 245, 415.1, 416, 419

[56] References Cited

U.S. PATENT DOCUMENTS

| | | | |
|---|---|---|---|
| 3,741,643 | 6/1973 | Smith et al. | 399/249 |
| 3,851,964 | 12/1974 | Smith et al. | 430/117 |
| 4,259,006 | 3/1981 | Phillips et al. | 399/249 |
| 5,481,342 | 1/1996 | Arcaro et al. | 399/249 |
| 5,987,285 | 11/1999 | Kusayanagi | 399/249 |
| 5,991,581 | 11/1999 | Kwak et al. | 399/237 |

FOREIGN PATENT DOCUMENTS

| | | |
|---|---|---|
| 59-57755 | 4/1984 | Japan . |
| 5-224539 | 9/1993 | Japan . |
| 8-211746 | 8/1996 | Japan . |
| 10-260584 | 9/1998 | Japan . |

*Primary Examiner*—Quana Grainger
*Attorney, Agent, or Firm*—Sughrue, Mion, Zinn, Macpeak & Seas, PLLC

[57] ABSTRACT

A developer removing apparatus is provided of a liquid printer for removing a developer remaining between a photoreceptor belt and a squeeze roller. The apparatus includes a suction nozzle having a suction portion formed in an axial direction of the squeeze roller to suck the developer and an exhaust portion for exhausting the developer sucked by the suction portion. The apparatus further includes a suction pump providing a suction force to the suction nozzle so that the suction portion can suck the developer and exhaust the developer from the exhaust portion.

4 Claims, 7 Drawing Sheets

DEVELOPER REMOVING APPARATUS OF LIQUID PRINTER

BACKGROUND OF THE INVENTION

1. Field of the Invention

The present invention relates to an apparatus for removing a developer remaining between a photoreceptor belt and a squeeze roller in a liquid printer.

2. Description of the Related Art

In general, a liquid printer such as a color laser printer or copier uses a developer, which is a mixture of solid toner of a predetermined color and a liquid carrier serving as a solvent, to develop an electrostatic latent image area formed on a photoreceptor medium such as a photoreceptor belt so that a desired image can be printed. For the above, the liquid printer is provided with a developing unit to develop the developer in the electrostatic latent image area. An example of the developing unit is shown in FIG. 1.

Referring to FIG. 1, a developing unit includes a developing roller 12 and a developer removing apparatus which are installed inside a main body 11. The developing roller 12 is installed to be capable of rotating by means of a driving source (not shown). A development gap G of a predetermined distance between the developing roller 12 and the photoreceptor belt 10 is maintained. The developing roller 12, rotated in the same direction that the photoreceptor belt 10 circulates, develops the developer in an electrostatic latent image area 10*a* of the photoreceptor belt 10. The developer is supplied by an injection nozzle 17.

The developer removing apparatus includes a first squeeze roller 13 installed adjacent to the developing roller 12, a second squeeze roller 14, a first blade 15, and a second blade 16. During developing, the first squeeze roller 13 squeezes the developer developed in the electrostatic latent image area 10*a*, while passively being rotated in contact with the photoreceptor belt 10. As a result toner of the developer is made filmy and most of the carriers except for the filmy toner are removed from the electrostatic latent image area 10*a*.

The second squeeze roller 14, while rotated in contact with the photoreceptor belt 10 in a reverse direction to the direction that the photoreceptor belt 10 circulates, removes the developer remaining on the photoreceptor belt 10 which is wrapped around both end regions of the first squeeze roller 13. The developer flowing along an outer circumferential surface of the second squeeze roller 14 is removed by the second blade 16.

After completion of the developing process, as shown in FIG. 2, a so-called drip-line continues to remain unnecessarily between the photoreceptor belt 10 and the first squeeze roller 13. The "drip-line," which can act as a contamination source in a subsequent developing process, should be removed. To remove the drip line from the photoreceptor belt 10, the circulation speed of the photoreceptor belt 10 is reduced, and the first squeeze roller 13 is reversely rotated in a state in which the first blade 15 is in contact with the first squeeze roller 13. The removed drip-line flows down along the first squeeze roller 13 and is finally removed by the first blade 15 and is dropped into the main body 11.

However, in the above conventional developer removing apparatus, since additional operations are required such as the circulation speed of the photoreceptor belt being reduced and the first squeeze roller being rotated reversely, the operation for removing a drip-line is complicated. Also, since the electrostatic latent image area of the photoreceptor belt is damaged due to friction by the first squeeze roller, the life span of the photoreceptor belt decreases.

SUMMARY OF THE INVENTION

To solve the above problems, it is an objective of the present invention to provide a developer removing apparatus of a liquid printer having an improved structure so that a drip-line developer remaining between the photoreceptor belt and the squeeze roller can be removed without contact.

Accordingly, to achieve the above objective, there is provided a developer removing apparatus of a liquid printer for removing a developer remaining between a photoreceptor belt and a squeeze roller. The apparatus includes a suction nozzle having a suction portion formed in an axial direction of the squeeze roller to suck the developer and an exhaust portion for exhausting the developer sucked by the suction portion. The apparatus further includes a suction pump providing a suction force to the suction nozzle so that the suction portion can suck the developer and contain the developer which is exhausted from the exhaust portion.

It is preferable in the present invention that the suction portion includes a first suction portion for sucking a developer wrapped around and toward both end regions of the squeeze roller, a second suction portion for sucking a drip-line remaining between the photoreceptor belt and the squeeze roller, and an opening/shutting means for selectively providing the suction force of the suction pump to the second suction portion.

It is preferable in the present invention that the developer removing apparatus of a liquid printer further includes a reservoir tank connected to the suction pump so that a developer sucked by the suction portion can be contained.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
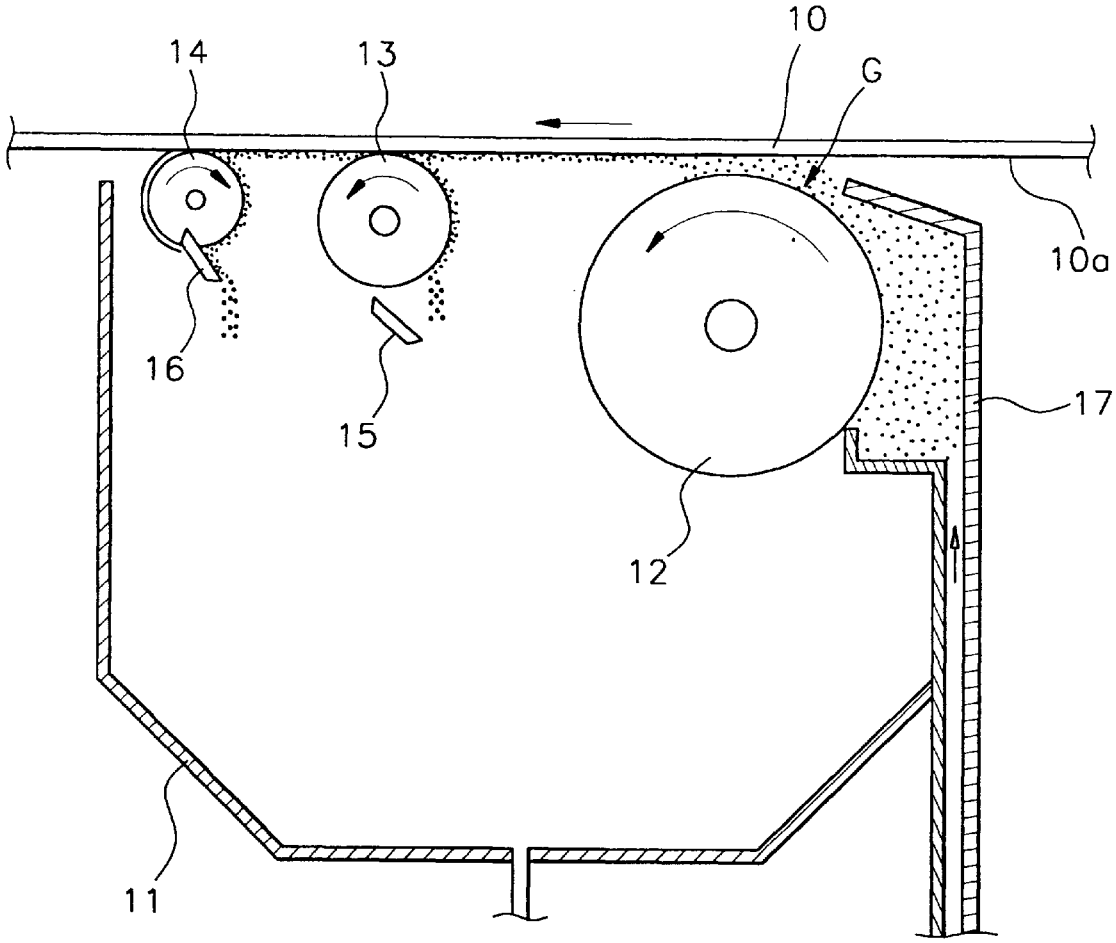
FIG. 1 (PRIOR ART)
FIG. 1 is a schematic view showing a conventional developing unit of a liquid printer.
Figure 2:
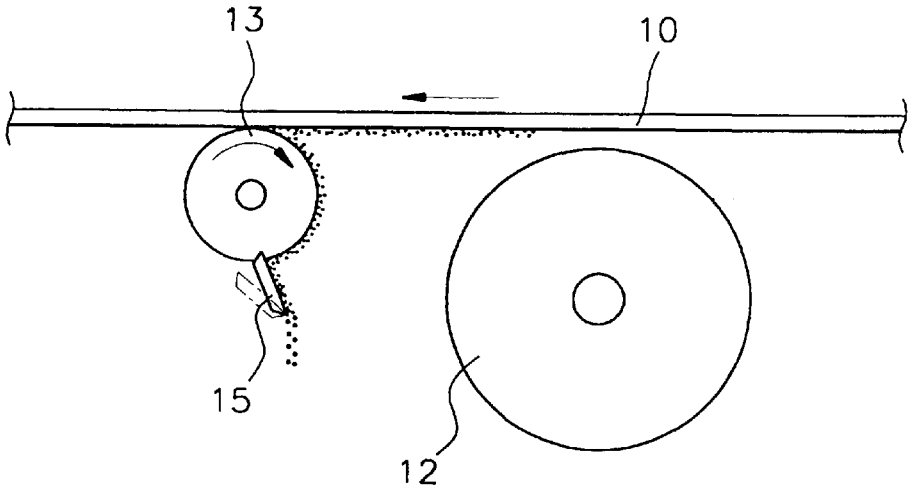
FIG. 2 (PRIOR ART)
FIG. 2 is a view for explaining a drip-line removing mode of a developing unit shown in FIG. 1.
Figure 3:
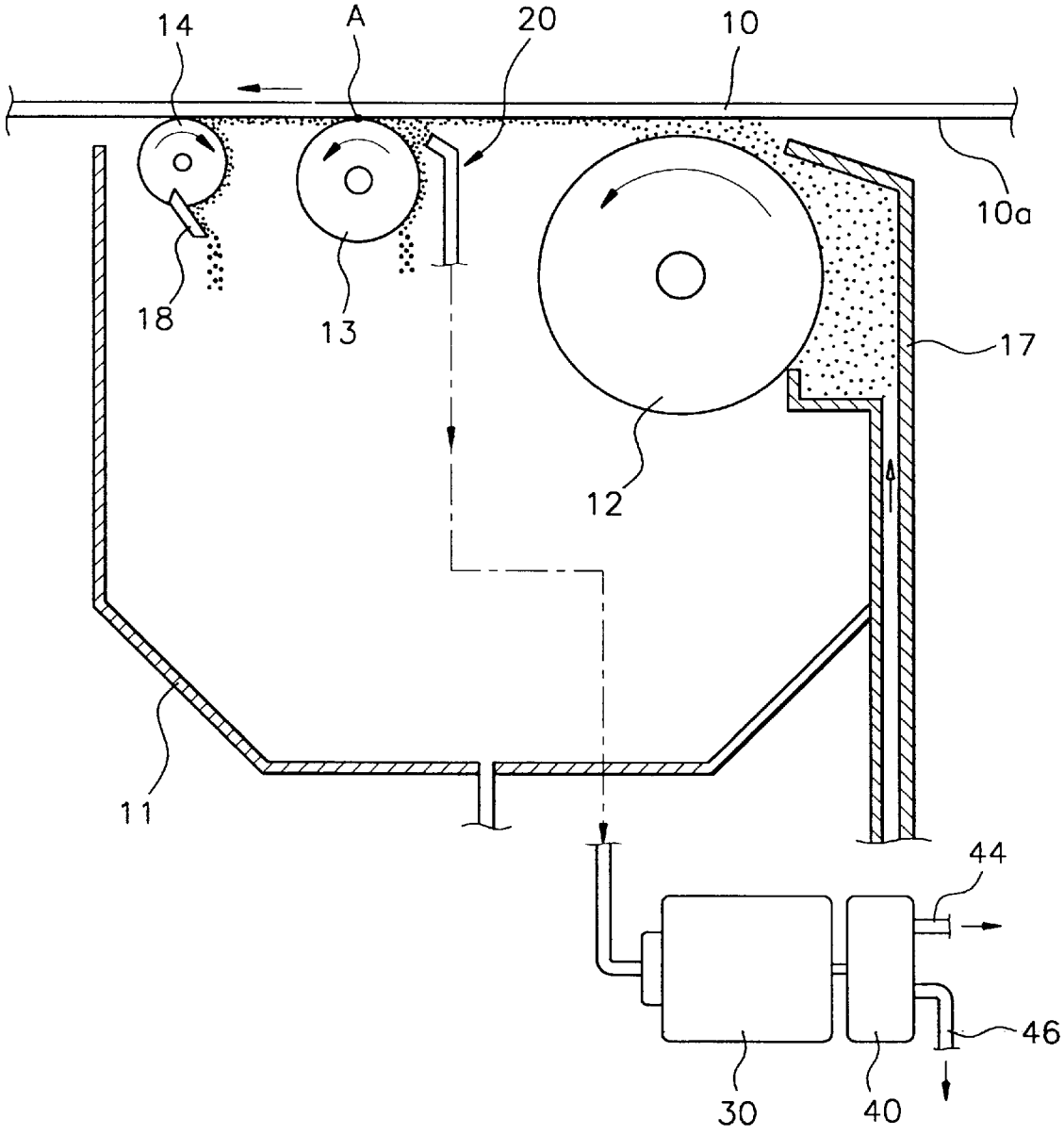
FIG. 3 is a view schematically showing a developer removing apparatus of a liquid printer according to a preferred embodiment of the present invention.
Figure 4:
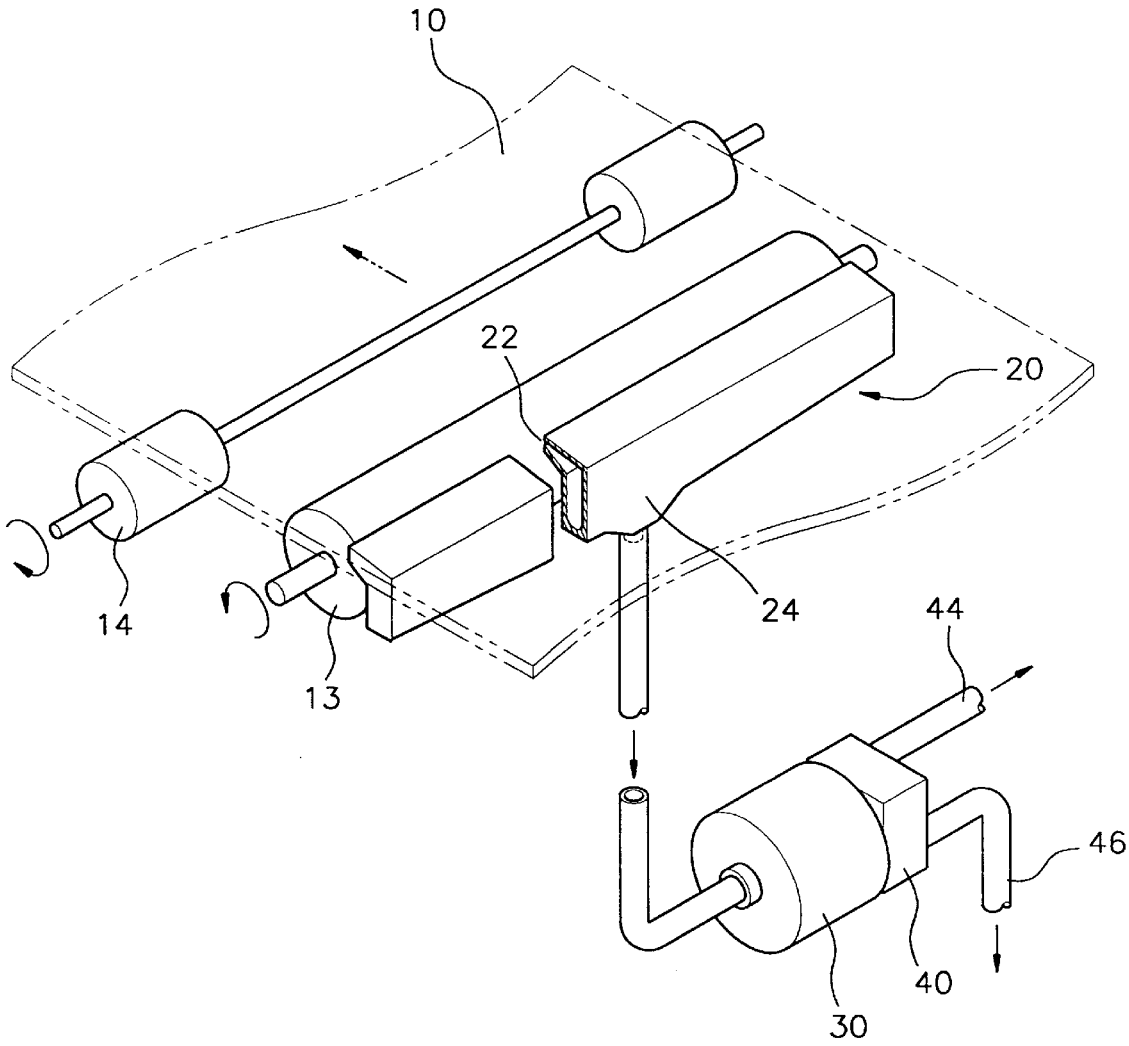
FIG. 4 is a perspective view showing major elements of the developer removing apparatus shown in FIG. 3.

FIG. 3 shows a developer removing apparatus of a liquid printer according to a preferred embodiment of the present invention; and FIG. 4 shows major elements of the developer removing apparatus shown in FIG. 3. In the drawings, the elements having the same reference numerals as in FIG. 1 indicate the same elements having the same functions. As shown in FIGS. 3 and 4, a suction nozzle 20 is installed in an axial direction of the first squeeze roller 13 and the suction nozzle 20 is connected to a suction pump 30.

The suction nozzle 20 includes a suction portion 22 provided to face a contact portion A between the first squeeze roller 13 and the photoreceptor belt 10 and an exhaust portion 24 connected to the suction pump 30. The suction portion 22 is preferably formed to be longer than the length of the first squeeze roller 13 so that the suction portion 22 can suck the developer remaining at the contact portion A.

The suction pump 30 provides a suction force to the suction nozzle 20 such that the suction portion 22 can suck the developer from around the contact portion A. A the reservoir tank 40 connected to the suction pump 30 contains the developer passing through the suction pump 30. An air exhaustion pipe 44 and a developer exhaust pipe 46 are connected to the reservoir tank 40. The air exhaustion pipe 44 is for exhausting air which is sucked together with the developer and the developer exhaust pipe 46 is for exhausting the developer contained in the reservoir tank 40 to an outside location.

When the reservoir tank 40 is full of developer and thus needs to be replaced thereof, it is possible to adopt a filter which is installed inside the reservoir tank 40 to effectively separate the developer from the air moving from the suction pump 30 due to high pressure.

The operation of the developer removing apparatus having the above structure according to a preferred embodiment of the present invention will now be described.

Figure 5:
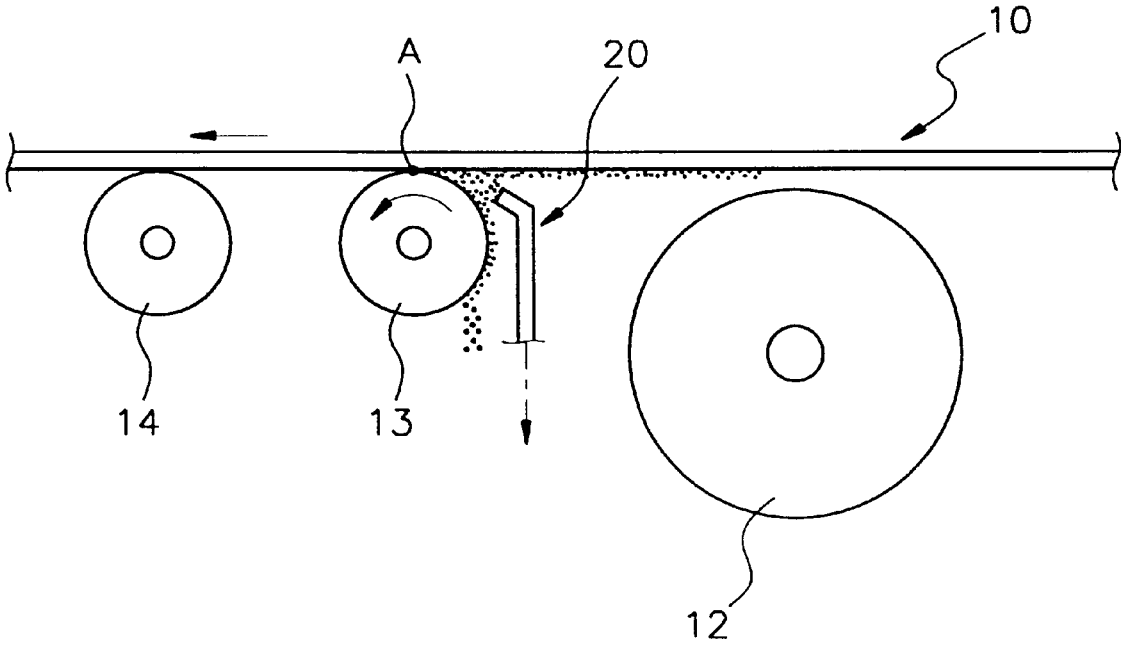
FIG. 5 is a view for showing the operation of the developer removing apparatus shown in FIG. 4.

A developer supplied from the injection nozzle 17 is developed by the developing roller 12 in the electrostatic latent image area 10*a* of the photoreceptor belt 10 and the "wrap-around" developer which is wrapped around both end regions of the first squeeze roller 13 is removed by the second squeeze roller 14, which are the same operations in a developing mode as those in the conventional technology. However, as shown in FIG. 5, in a drip-line removing mode, the present invention conducts the operations without lowering the rotational speed of the photoreceptor belt 10 and without reversing the rotational direction of the first squeeze roller 13 that is passively rotated by the photoreceptor 10. The suction pump 30 is driven by a predetermined driving source to suck the drip-line developer using the suction portion 22 of the suction nozzle 20 and exhaust the sucked developer into the reservoir tank 40.

Accordingly, since the drip-line developer can be removed by the suction nozzle 20 which is not in contact with the photoreceptor belt 10, such additional actions as lowering the circulation speed of the photoreceptor belt 10 and reversing the rotational direction of the first squeeze roller 13 are not needed. Therefore, damage to the photoreceptor belt 10 can be reduced and the life span thereof can be extended.

Figure 6:
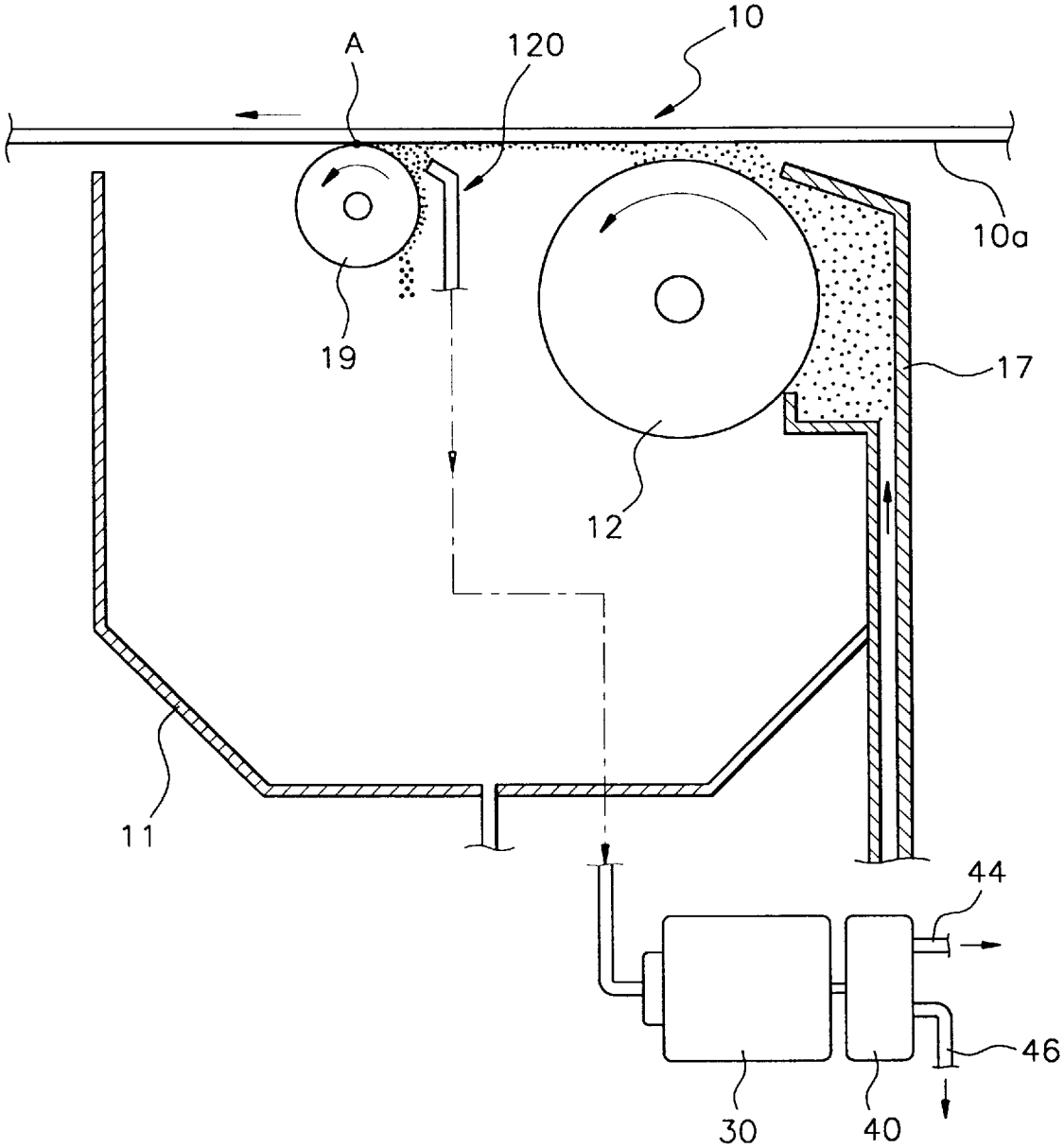
FIG. 6 is a schematic view showing the structure of a developer removing apparatus of a liquid printer according to another preferred embodiment of the present invention.
Figure 7:
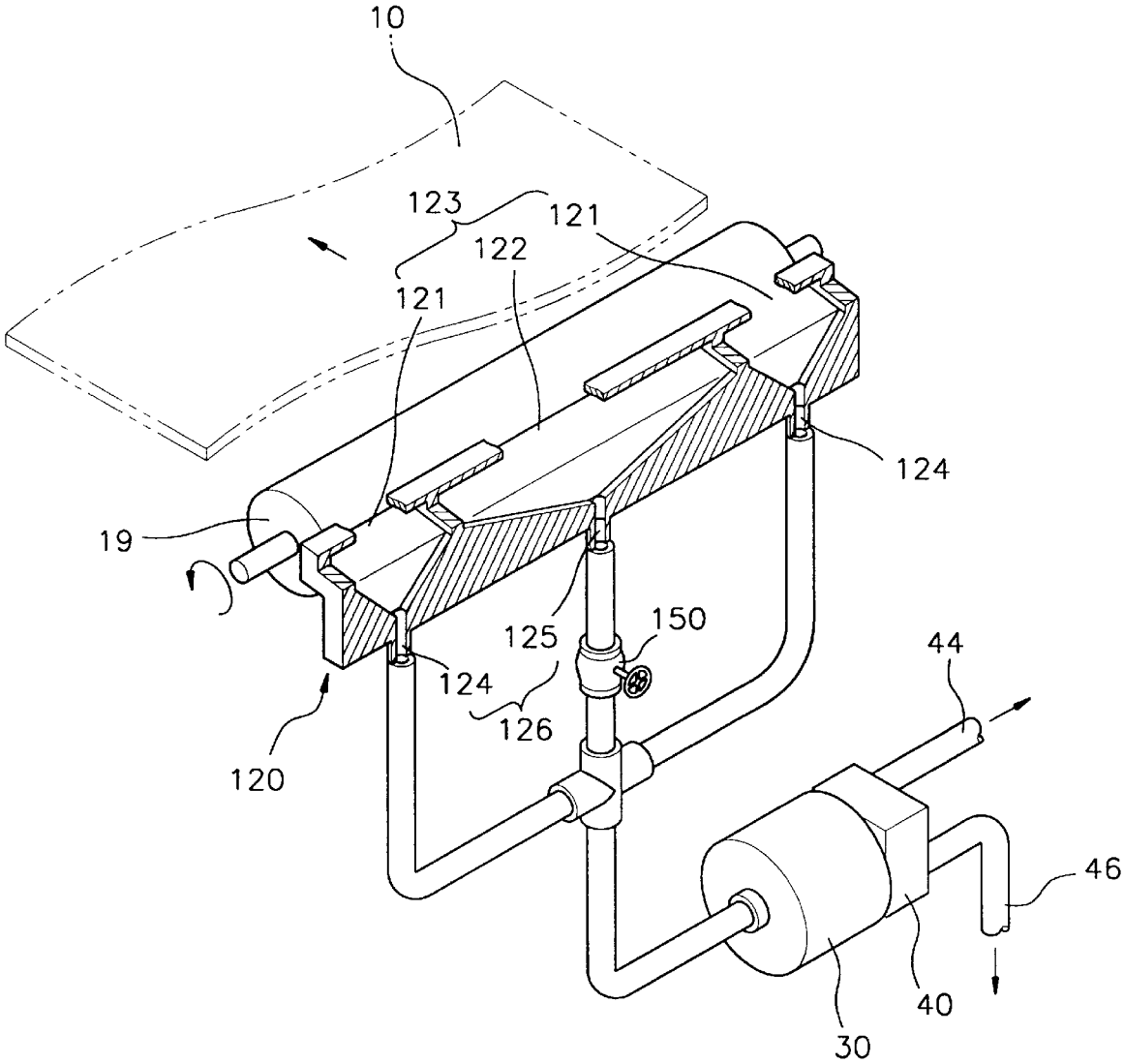
FIG. 7 is a perspective partially cut-away view showing major elements of the developer removing apparatus shown in FIG. 6.

A developer removing apparatus according to another preferred embodiment of the present invention is shown in FIGS. 6 and 7. As shown in the drawings, the developer removing apparatus includes a squeeze roller 19 installed to be passively rotated by a photoreceptor belt 10, a suction nozzle 120 installed to be separated from the squeeze roller 19 and extending along the axial direction of the squeeze roller 19, a suction pump 30 connected to the suction nozzle 120, and a separating means. Here, the elements having the same reference numerals as those in FIG. 3 have the same functions.

The suction nozzle 120 includes suction portions 123 for sucking a developer remaining around the contact portion A between the photoreceptor belt 10 and the squeeze roller 19, and an exhaust portion 126 for exhausting the developer sucked by the suction portion 123.

The suction portions 123 are formed at a front end of the suction nozzle 120 to face the entire area of the contact portion A and to be longer than the length of the squeeze roller 19. The suction portions 123 includes a pair of first suction portions 121 provided to face both end portions of the squeeze roller 19 and a second suction portion 122 provided between the respective first suction portions 121. The first suction portion 121 sucks the developer flowing toward both ends of the squeeze roller 19 during a developing operation and the second suction portion 122 sucks the drip-line developer remaining between the photoreceptor belt 10 and the squeeze roller 19 during a drip-line removing mode. Thus, the first suction 121 and the second suction portion 122 are separated from one another in the section nozzle 120.

The exhaust portion 126 for exhausting the developer sucked by the suction portions 123 toward the suction pump 30 includes a pair of first exhaust portions 124 and the second exhaust a 125. The first exhaust portions 124 and the second exhaust portion 125 are connection to the first suction portions 121 and the second suction portion 122, respectively. Both the first and second exhaust portions 124 and 125 are connected to the suction pump 30. Also, an opening/shutting means such as a solenoid valve 150 is installed at the second exhaust portion 125. The solenoid valve 150 is selectively operated according to the developing mode or the drip-line removing mode so that a suction force of the suction pump 30 is selectively provided toward the second suction portion 122.

A reservoir tank 40 is connected to the suction pump 30 as shown in FIGS. 3 and 4. An air exhaust pipe 44 and a developer exhaust pipe 46 are connected to the reservoir tank 40.

The operation of the developer removing apparatus according to another preferred embodiment of the present invention will be described as follows.

Figure 8:
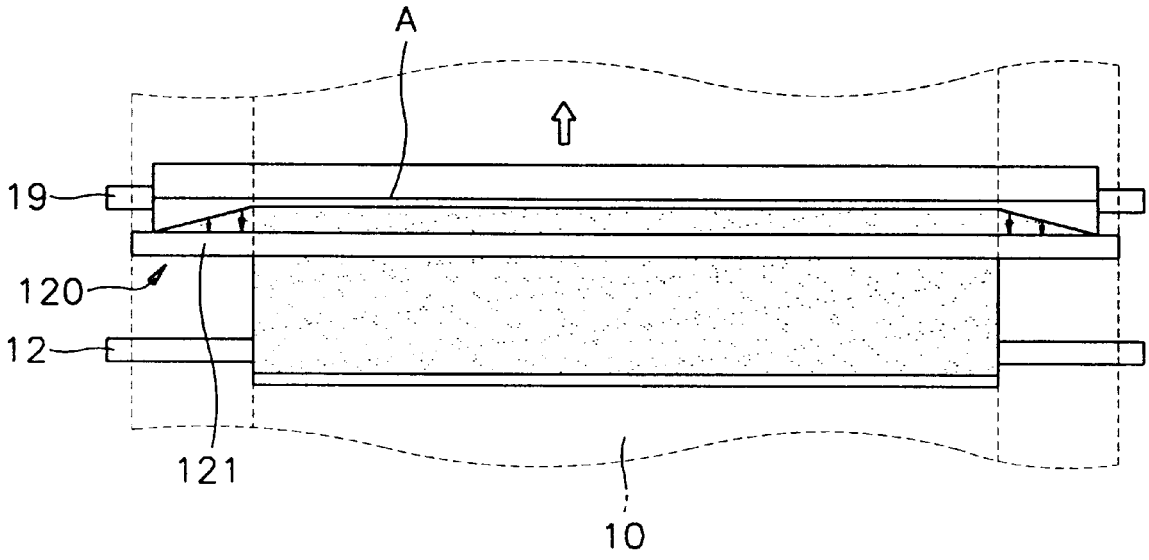
FIGS. 8 and 9 are views for explaining the operation of the developer removing apparatus shown in FIG. 7.

As shown in FIG. 8, in a developing mode, to prevent the developer at the middle portion of the squeeze roller 19 from flowing toward both ends of the squeeze roller 19 and being wrapped around, the solenoid valve 150 is turned off to apply the suction force of the suction pump 30 to the first suction portions 121. Then, the developer which is to be wrapped around is exhausted to the reservoir tank 40 through the first exhaust portions 124 and the suction pump 30.

During the above developing mode, the solenoid valve 150 closes the second exhaust portion 125. Accordingly, the second suction portion 122 is not provided with the suction force from the suction pump 30 and is not able to perform the suction action. As a result, during the developing operation, the developer at the middle portion of the squeeze roller 19 is prevented from being damaged by the suction force of the suction pump 30 and concurrently the developer to be wrapped around is removed effectively.

Therefore, the developer flowing toward both ends of the squeeze roller 19 can be essentially removed by the first suction portions 121 of the suction nozzle 120. Thus, the second squeeze roller (see 14 of FIG. 1) according to the conventional technology can be excluded.

Figure 9:
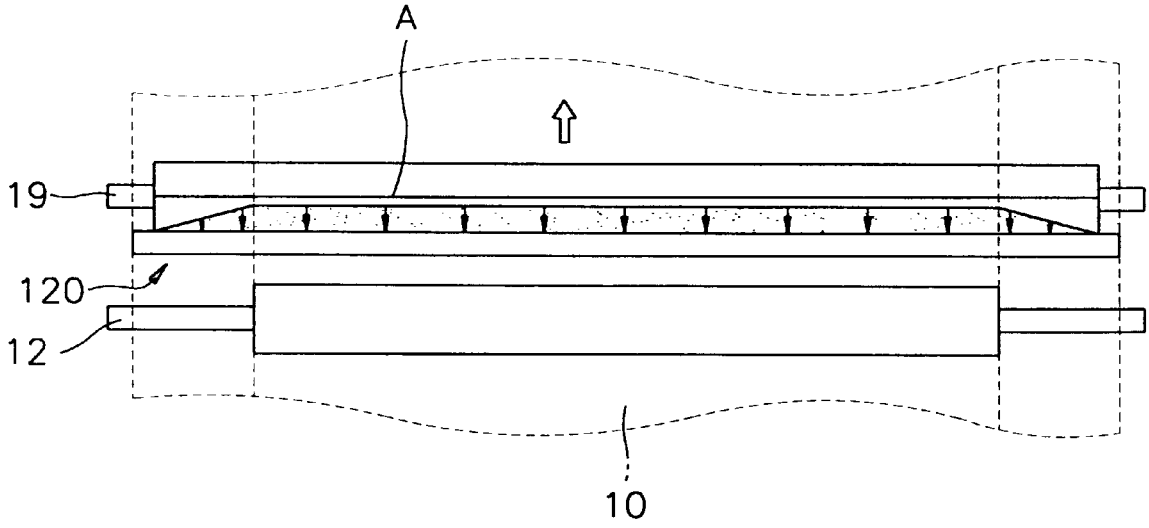

As shown in FIG. 9, in the drip-line removing mode, the second exhaust portion 125 is turned on, i.e., to be open, so that the suction force by the suction pump 30 is simultaneously provided to the first suction portions 121 and the second suction portion 122. Then, the drip-line developer between the photoreceptor belt 10 and the squeeze roller 19 is sucked and removed by the suction nozzle 120.

As described above, the developer removing apparatus of a liquid printer according to the present invention has advantages as follows.

First, a drip-line developer remaining between the photoreceptor belt and the squeeze roller can be simply removed by the suction nozzle which is not in contact with the photoreceptor belt;

Second, damage to the photoreceptor belt due to a reverse rotation of the squeeze roller can be prevented; and Third, since the wrap around phenomenon can be prevented when the suction nozzle is operated even in the developing mode, the second squeeze roller can be excluded. Thus, the width of the photoreceptor belt can be reduced.

What is claimed is:

1. A developer removing apparatus of a liquid printer for removing a developer remaining between a photoreceptor belt and a squeeze roller, said apparatus comprising:

a suction nozzle having a suction portion formed in an axial direction of said squeeze roller to suck the developer and an exhaust portion for exhausting the developer sucked by said suction portion; and a suction pump providing a suction force to said suction nozzle so that said suction portion can suck the developer and exhaust the developer from said exhaust portion, wherein said suction portion comprises:

a first suction portion for sucking the developer wrapped around end regions of said squeeze roller;

a second suction portion for sucking a drip-line remaining between said photoreceptor belt and said squeeze roller; and opening/shutting means for selectively providing the suction force of said suction pump to said second suction portion.

2. The apparatus as claimed in claim 1, further comprising a reservoir tank connected to said suction pump so that the developer sucked by the suction portion can be contained.

3. A developer removing apparatus of a liquid printer for removing a developer remaining between a photoreceptor belt and a squeeze roller, said apparatus comprising:

a suction nozzle having a suction portion formed in an axial direction of said squeeze roller to suck the developer and an exhaust portion for exhausting the developer sucked by said suction portion; and a suction pump providing a suction force to said suction nozzle so that said suction portion can suck the developer and exhaust the developer from said exhaust portion, wherein said suction portion comprises:

a first suction portion for sucking the developer wrapped around end regions of said squeeze roller;

a second portion for sucking a drip-line remaining between aid photoreceptor belt and said squeeze roller; and a valve for selectively providing the suction force of said suction pump to said second suction portion.

4. The apparatus as claimed in claim 3, further comprising a reservoir tank connected to said suction pump so that the developer sucked by the suction portion can be contained.

* * * * *